US008708662B2

(12) United States Patent
Hu et al.

(10) Patent No.: US 8,708,662 B2
(45) Date of Patent: Apr. 29, 2014

(54) LINEAR COMPRESSOR

(75) Inventors: Jin Seok Hu, Masna-si (KR); Shin Hyun Park, Pusan (KR); Young Geul Kim, Pusan (KR); Kyo Lyong Kang, Changnyeong-gun (KR)

(73) Assignee: LG Electronic Inc., Seoul (KR)

( * ) Notice: Subject to any disclaimer, the term of this patent is extended or adjusted under 35 U.S.C. 154(b) by 171 days.

(21) Appl. No.: 13/133,065

(22) PCT Filed: Feb. 22, 2011

(86) PCT No.: PCT/KR2011/001130

§ 371 (c)(1),
(2), (4) Date: Jun. 6, 2011

(87) PCT Pub. No.: WO2011/105723

PCT Pub. Date: Sep. 1, 2011

(65) Prior Publication Data

US 2011/0318193 A1 Dec. 29, 2011

(30) Foreign Application Priority Data

Feb. 24, 2010 (KR) ..... 10-2010-0016683

(51) Int. Cl.

| | |
|---|---|
| ***F04B 49/06*** | (2006.01) |
| ***F04B 35/04*** | (2006.01) |
| ***F04B 17/04*** | (2006.01) |
| ***H02K 33/12*** | (2006.01) |
| ***H02K 41/02*** | (2006.01) |

(52) U.S. Cl.
USPC ..... 417/44.11; 417/416; 318/119; 318/135; 318/687

(58) Field of Classification Search
USPC ..... 417/44.1, 45, 44.11, 53, 415, 416, 417, 417/902
See application file for complete search history.

(56) References Cited

U.S. PATENT DOCUMENTS

| | | | | |
|---|---|---|---|---|
| 6,537,034 | B2 * | 3/2003 | Kim et al. | 417/44.1 |
| 2003/0161735 | A1 | 8/2003 | Kim et al. | |

FOREIGN PATENT DOCUMENTS

| | | | | |
|---|---|---|---|---|
| JP | 2003-254249 | | 9/2003 | |
| KR | 10-0500528 | | 7/2005 | |
| KR | 10-0633155 | | 10/2006 | |
| KR | 10-2010-0008307 | | 1/2010 | |
| KR | 20100008307 | * | 1/2010 | F04B 35/04 |

OTHER PUBLICATIONS

International Search Report dated Oct. 24, 2011. (PCT/KR2011/001130). (English Translation).
International Search Report dated Oct. 24, 2011. (PCT/KR2011/001130).

* cited by examiner

*Primary Examiner* — Bryan Lettman
(74) *Attorney, Agent, or Firm* — KED & Associates, LLP

(57) ABSTRACT

A linear compressor for adjusting a variable rate of a cooling capacity is provided. The linear compressor may include a fixed member having a compression space formed therein, a movable member linearly reciprocated in the fixed member to compress a refrigerant drawn into the compression space, one or more springs provided to elastically support the movable member in the motion direction of the movable member, a motor unit including a motor connected to the movable member to linearly reciprocate the movable member in the axial direction and a capacitor connected in series to the motor, and a motor control unit controlling an AC voltage applied to the motor to adjust a variable rate of a cooling capacity by the reciprocation of the movable member.

9 Claims, 5 Drawing Sheets

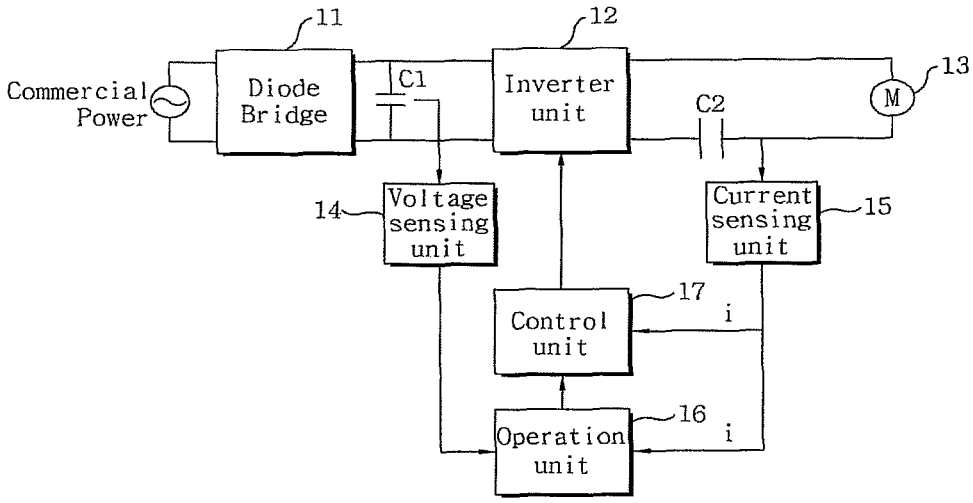
FIG. 2
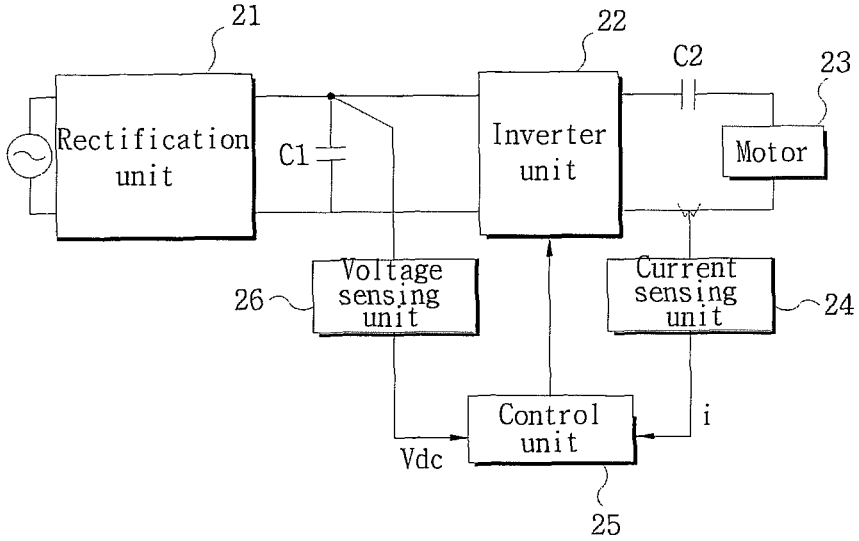

LINEAR COMPRESSOR

TECHNICAL FIELD

The present invention relates to a linear compressor, and, more particularly, to a linear compressor which makes it possible to adjust a variable rate of a cooling capacity.

BACKGROUND ART

In general, a motor is provided in a compressor which is a mechanical apparatus for receiving power from a power generation apparatus, such as an electric motor, a turbine, etc. and compressing the air, refrigerant or other various operating gases to raise a pressure. The motor has been widely used in electric home appliances such as refrigerators, air conditioners, etc., and its application has been expanded to the whole industry.

In particular, the compressors are roughly classified into a reciprocating compressor in which a compression space for sucking and discharging an operating gas is defined between a piston and a cylinder so that the piston can be linearly reciprocated in the cylinder to compress a refrigerant, a rotary compressor in which a compression space for sucking and discharging an operating gas is defined between an eccentrically-rotated roller and a cylinder so that the roller can be eccentrically rotated along the inner wall of the cylinder to compress a refrigerant, and a scroll compressor in which a compression space for sucking and discharging an operating gas is defined between an orbiting scroll and a fixed scroll so that the orbiting scroll can be rotated along the fixed scroll to compress a refrigerant.

Recently, a linear compressor which not only improves a compression efficiency but also has a simple structure has been actively developed among the reciprocating compressors. In particular, the linear compressor does not have a mechanical loss caused by a motion conversion since a piston is directly connected to a linearly-reciprocating driving motor.

FIG. 1 is a block diagram of a motor control device used in a conventional linear compressor.

As illustrated in FIG. 1, the motor control device includes a rectification unit having a diode bridge 11 receiving, rectifying and outputting AC power which is commercial power and a capacitor C1 smoothing the rectified voltage, an inverter unit 12 receiving a DC voltage, converting the DC voltage to an AC voltage according to a control signal from a control unit 17, and supplying the AC voltage to a motor unit, the motor unit having a motor 13 and a capacitor C2 connected in series to the motor 13, a voltage sensing unit 14 sensing a both-end voltage of the capacitor C1, a current sensing unit 15 sensing a current flowing through the motor unit, an operation unit 16 operating a counter electromotive force (EMF) from the voltage sensed by the voltage sensing unit 14 and the current sensed by the current sensing unit 15, and the control unit 17 generating a control signal by reflecting the counter EMF from the operation unit 16 and the current sensed by the current sensing unit 15.

Although the cooling capacity variability characteristics based on the load are determined by the capacity of the capacitor C2, conventionally, it is not easy to change the capacity of the capacitor C2. Further, the provision and selective connection of a plurality of capacitors cause difficulties in terms of cost, space, and design.

DISCLOSURE OF THE INVENTION

An object of the present invention is to provide a linear compressor which makes it possible to control the variable rate of the cooling capacity and a control method therefor.

Another object of the present invention is to provide a linear compressor which can adjust a naturally variable rate of cooling capacity based on a load capacity and a control method therefor.

A further object of the present invention is to provide a linear compressor which can vary or modulate a cooling capacity as required, even when a cooling capacity greater than a load is necessary, and a control method therefor.

According to an aspect of the present invention, there is provided a linear compressor including: a fixed member having a compression space therein; a movable member linearly reciprocated in the fixed member to compress a refrigerant sucked into the compression space; one or more springs provided to elastically support the movable member in the motion direction of the movable member; a motor unit including a motor connected to the movable member to linearly reciprocate the movable member in the axial direction and a capacitor connected in series to the motor; and a motor control unit controlling an AC voltage applied to the motor to adjust a variable rate of a cooling capacity by the reciprocation of the movable member.

In addition, the stroke of the movable member may be proportional to the magnitude of the AC voltage applied to the motor at least in close proximity to the top dead center of the movable member.

Moreover, the motor control unit may include an attenuation operation unit attenuating an inductance effect of a coil of the motor by using a current flowing through the motor.

Additionally, the motor control unit may include a rectification unit receiving AC power and outputting a DC voltage, an inverter unit receiving the DC voltage, converting the DC voltage to an AC voltage according to a control signal, and supplying the AC voltage to the motor unit, a current sensing unit sensing a current flowing through the motor unit, and a control unit integrating the current from the current sensing unit, operating an attenuation voltage by multiplying the integrated value by a constant 1/Cr, generating a control signal for producing an AC voltage corresponding to a difference between the set voltage and the attenuation voltage, and applying the control signal to the inverter unit.

Further, the constant 1/Cr may be variable.

Furthermore, the variable rate of a cooling capacity of the compressor may be adjusted by varying the constant 1/Cr.

Still furthermore, the control unit may control the total capacity of the capacitors connected in series to the motor.

According to another aspect of the present invention, there is provided a method for controlling a linear compressor which includes a fixed member having a compression space therein, a movable member provided in the fixed member to compress a refrigerant sucked into the compression space, one or more springs provided to elastically support the movable member, and a motor unit including a motor connected to the movable member to linearly reciprocate the movable member in the axial direction and a capacitor connected in series to the motor, the method including: a first step of applying a preset initial voltage to the motor; a second step of calculating a first attenuation voltage with a current produced by the application of the preset initial voltage; a third step of calculating a first required voltage corresponding to a difference between the initial voltage and the first attenuation voltage; a fourth step of applying the first required voltage to the motor; a fifth step of calculating a second attenuation voltage with a current produced by the application of the first required voltage; a sixth step of calculating a second required voltage corresponding to a difference between the initial voltage and the second attenuation voltage; and a seventh step of applying the second required voltage to the motor.

According to the present invention, even when the motor of the linear compressor is provided with a single capacitor or a certain capacitance, it is possible to control the variable rate of the cooling capacity such as a high, mid and low cooling capacity.

Additionally, according to the present invention, it is possible to simply and rapidly adjust the naturally variable rate of the cooling capacity based on the load capacity.

Moreover, according to the present invention, it is possible to prevent a stroke jump phenomenon which may occur during the control of the linear compressor.

Further, according to the present invention, it is possible to vary or modulate the cooling capacity as required, even when a cooling capacity greater than a load is necessary.

BRIEF DESCRIPTION OF THE DRAWINGS

FIG. 1 is a block diagram of a motor control device used in a conventional linear compressor.

FIG. 2 is a block diagram of a control mechanism of a linear compressor according to the present invention.

BEST MODE FOR CARRYING OUT THE INVENTION

Hereinafter, exemplary embodiments of the present invention will be described in detail with reference to the attached drawings.

Figure 3:
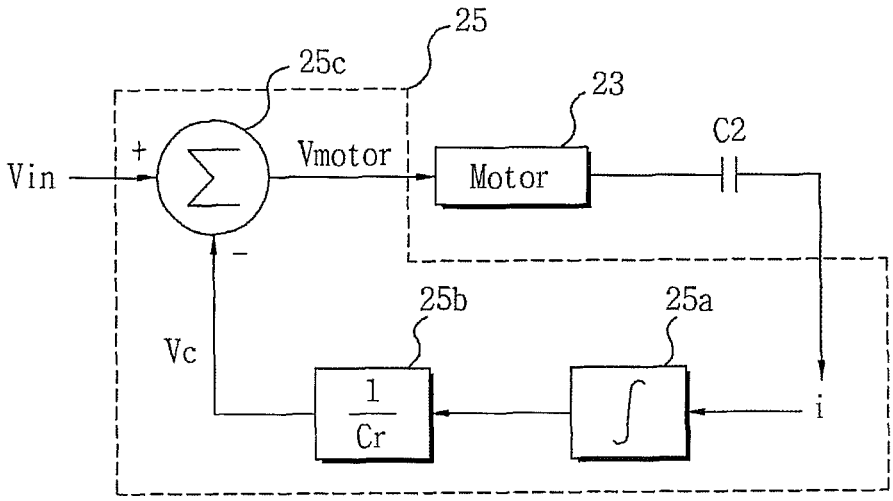
FIG. 3 is a circuit diagram of a control example of a control unit of FIG. 2.

FIG. 2 is a block diagram of a control mechanism of a linear compressor according to the present invention and FIG. 3 is a circuit diagram of a control example of a control unit of FIG. 2.

As illustrated in FIG. 2, the control mechanism of the linear compressor includes a rectification unit 21 receiving, rectifying, smoothing, and outputting AC power which is commercial power, an inverter unit 22 receiving a DC voltage, converting the DC voltage to an AC voltage according to a control signal from a control unit 25, and supplying the AC voltage to a motor 23, a motor unit including a coil L and a capacitor C2 connected in series, a current sensing unit 24 sensing a current flowing between the motor unit and the inverter unit 22 or a current flowing through the coil L in the motor unit, the control unit 25 operating a motor application voltage Vmotor to be applied to the motor 23 or the motor unit, based on the current sensed by the current sensing unit 24, generating a corresponding control signal, and applying the control signal to the inverter unit 22, and a voltage sensing unit 26 sensing the magnitude of the DC voltage from the rectification unit 21. However, in this control mechanism, the structure for supplying a required voltage to the control unit 25, the current sensing unit 24, the voltage sensing unit 26, etc. is obvious to a person of the ordinary skill in the art to which the present invention pertains, and thus a description thereof will be omitted.

The rectification unit 21 is composed of a diode bridge performing a general rectification function, a capacitor C1 smoothing the rectified voltage, and so on. The rectification unit 21 and the capacitor C1 may be provided separately as shown in FIG. 2 or provided as a single rectification unit.

The inverter unit 22, which is a means for receiving a DC voltage, generating an AC voltage, and applying the AC voltage to the motor 23, includes an IGBT element which is a switching element, a gate control unit turning on/off the IGBT element according to a control signal from the control unit 25, and so on. The inverter unit 22 is easily recognized by a person of the ordinary skill in the art to which the present invention pertains, and thus a description thereof will be omitted.

The motor 23 includes the coil L like a general motor of other mechanical structures, and the capacitor C2 is connected thereto in series. Hereafter, the motor 23 and the capacitor C2 are referred to as the motor unit.

The current sensing unit 24 is an element for sensing a current flowing through a conductive line between the inverter unit 22 and the motor 23 or a current flowing through the coil L of the motor 23.

The voltage sensing unit 26 is an element for sensing a DC voltage output from the rectification unit 21 or a both-end voltage of the capacitor C1. Here, the voltage sensing unit 26 can sense the entire DC voltage or a DC voltage reduced at a given ratio.

When receiving a starting command of the linear compressor from an external source or receiving AC commercial power, the control unit 25 generates a control signal for transferring a preset application voltage Vin to the motor 23 and applies the control signal to the inverter unit 22. Accordingly, the inverter unit 22 generates an AC voltage corresponding to the application voltage Vin and applies the AC voltage to the motor 23.

The current sensing unit 24 senses a current i flowing from the inverter unit 22 to the motor 23 or a current i flowing through the coil L of the motor 23 by the application of this AC voltage.

The control unit 25 receives the current i from the current sensing unit 24 and performs the processing shown in FIG. 3.

The control unit 25 includes an integrator 25*a* integrating the current i from the current sensing unit 24, an attenuator 25*b* operating an attenuation voltage Vc by multiplying the integrated value by a constant 1/Cr, and an operation unit 25*c* operating a difference between the set application voltage Vin and the attenuation voltage Vc. The application voltage Vin of this embodiment, which corresponds to the voltage applied by the inverter unit in the conventional compressor, is fixed or varied according to the control algorithm of the linear compressor.

The integrator 25*a* and the attenuator 25*b* correspond to an attenuation operation unit which attenuates the inductance effect of the coil L of the motor, using the current i flowing through the motor 23. That is, in this embodiment, while there is the capacitor C2 connected to the coil L of the motor 23, the inductance effect of the coil L is additionally reduced or maintained by controlling the motor application voltage Vmotor applied to the motor 23.

As illustrated in FIG. 3, the current i applied to the control unit 25 has been influenced by the capacitor C2 connected to the motor 23. Then, since this current i is influenced again by the integrator 25*a* and the attenuator 25*b* embodied in the control unit 25, it should be recognized as flowing through a software-type capacitor Cr. Accordingly, it should be recognized that the hardware-type capacitor C2 and the software-type capacitor Cr are connected in series. Thus, the total capacity Ctotal of the capacitors connected in series to the motor 23 is calculated by the following formula:

$$Ctotal=(C\times Cvirtual)/(C+Cvirtual) \quad \text{Formula 1}$$

wherein C denotes the capacity of the capacitor C2 and Cvirtual is a constant Cr.

As can be seen in Formula 1, Ctotal cannot be greater than C which is the capacity of the capacitor C2. Therefore, in the design of the present control device, the capacitor C2 should have a capacity corresponding to the maximum available cooling capacity of the present compressor. Thereafter, the control device should be operated in such a manner that it maintains or reduces the total capacity Ctotal of the capacitors by varying Cvirtual which is the constant Cr. For example, the capacity of the capacitor C2 can be set according to the size of the coil L of the motor 23, and an LC resonance frequency (a frequency by the capacitor C2 and the coil L) can be set to correspond to a mechanical resonance frequency of the compressor.

As such, after operating the motor application voltage Vmotor, the control unit 25 generates a control signal for controlling the inverter unit 22 to transfer the operated motor application voltage Vmotor to the motor 23 or the motor unit and applies the control signal to the inverter unit 22. That is, the control unit 25 allows the sensed current i to be fed back to the motor application voltage Vmotor, thus being able to control the operation of the motor 23. In the present invention, since the counter EMF is reflected to the current i and fed back, it can be ignored. Thereafter, the control unit 25 repeatedly calculates and provides the motor application voltage Vmotor according to a difference between the application voltage Vin which is an initial voltage and the attenuation voltage which is obtained by integrating the current produced by the applied motor application voltage Vmotor (e.g., a first attenuation voltage by the application voltage Vin, a second attenuation voltage by the primarily-calculated motor application voltage Vmotor, etc.).

The higher the load, the greater the motor application voltage Vmotor which is the required voltage. In the present invention, if the motor application voltage Vmotor (i.e., the maximum value) which is the required voltage is smaller than the DC voltage Vdc, the current state is determined as a low or mid load. In the case of the low or mid load, the inverter unit 22 applies an AC voltage (motor application voltage Vmotor) having a magnitude equal to or smaller than the DC voltage Vdc to the motor unit or the motor 23. Hence, the control unit 25 can maintain the required cooling capacity by adjusting the magnitude of the AC voltage applied from the inverter unit 22 to the motor unit or the motor 23.

Further, the control unit 25 can attain as a high cooling capacity as required by varying a frequency of the motor application voltage Vmotor from the inverter unit 22, e.g., by increasing a frequency at a high load.

Figure 4:
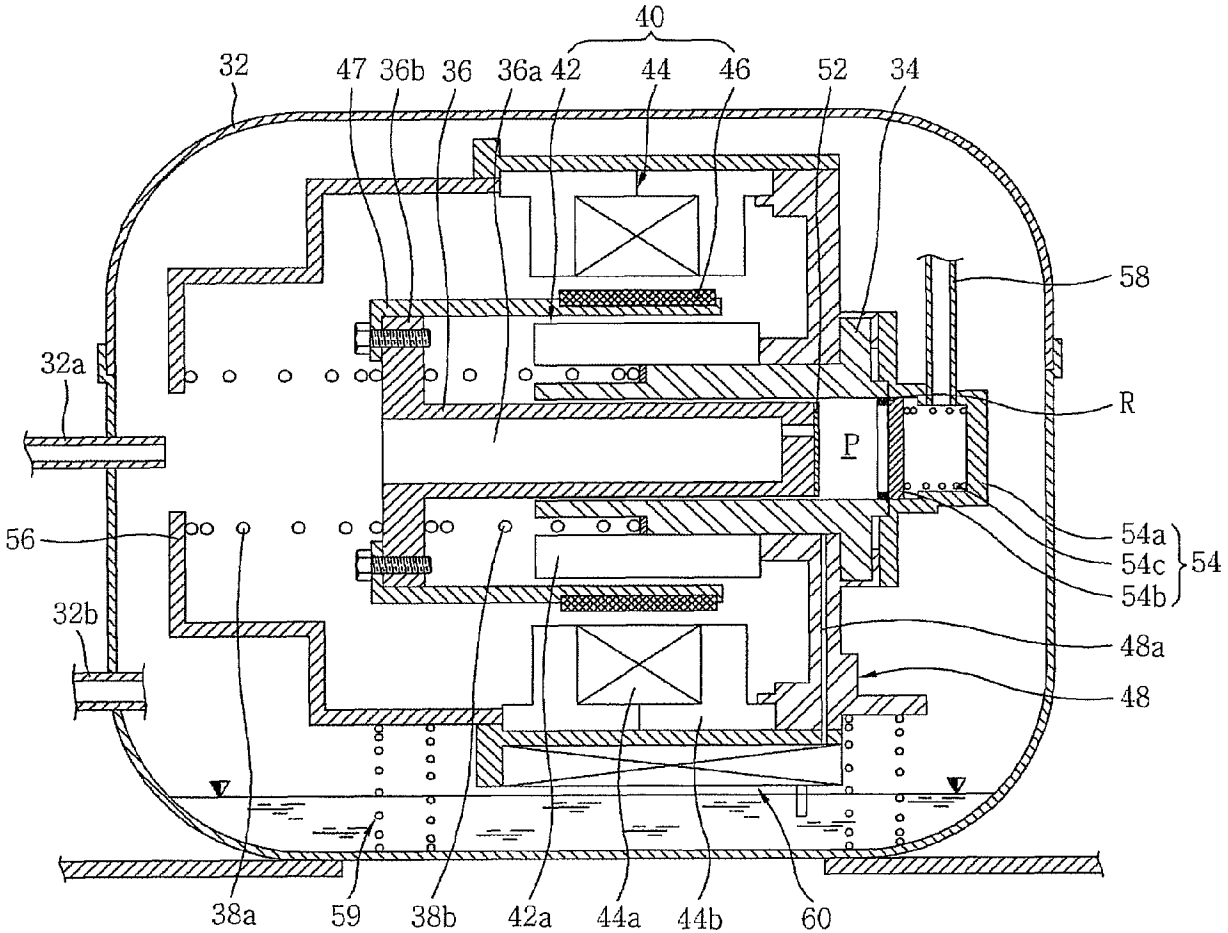
FIG. 4 is a structure diagram of the linear compressor according to the present invention.

FIG. 4 is a structure diagram of the linear compressor according to the present invention. As illustrated in FIG. 4, in the linear compressor according to the present invention, an inlet pipe 32*a* and an outlet pipe 32*b* through which a refrigerant flows in and out are provided at one side of a hermetic container 32, a cylinder 34 is fixedly installed in the hermetic container 32, a piston 36 is provided to be linearly reciprocated in the cylinder 34 to be able to compress the refrigerant sucked into a compression space P in the cylinder 34, and various springs are provided to elastically support the piston 36 in the motion direction of the piston 36. The piston 36 is provided to be connected to a linear motor 40 which produces a linear reciprocation driving force. Although a natural frequency fn of the piston 36 is changed according to a load, the linear motor 40 induces a natural output change which varies or modulates the cooling capacity (output) according to the changed load.

Moreover, a suction valve 52 is provided at one end of the piston 36 which is in contact with the compression space P and a discharge valve assembly 54 is provided at one end of the cylinder 34 which is in contact with the compression space P. The suction valve 52 and the discharge valve assembly 54 are automatically opened and closed according to the pressure inside the compression space P, respectively.

Here, the hermetic container 32 has its upper and lower shells coupled to each other to seal up the inside, the inlet pipe 32*a* for introducing the refrigerant and the outlet pipe 32*b* for discharging the refrigerant are provided at one side of the hermetic container 32, the piston 36 is elastically supported in the motion direction to be linearly reciprocated in the cylinder 34, and the linear motor 40 is coupled to the outside of the cylinder 34 by a frame 48 to constitute an assembly. This assembly is provided on the inside bottom surface of the hermetic container 32 to be elastically supported by supporting springs 59.

Further, given oil is filled in the inside bottom surface of the hermetic container 32, an oil supply apparatus 60 pumping the oil is provided at a bottom end of the assembly, and an oil supply pipe 48*a* is provided in the frame 48 on the lower side of the assembly to be able to supply the oil between the piston 36 and the cylinder 34. Therefore, the oil supply apparatus 60 pumps out the oil due to the vibration caused by linear reciprocation of the piston 36, so that the oil is supplied to a gap between the piston 36 and the cylinder 34 along the oil supply pipe 48*a* and performs cooling and lubricating functions.

Next, it is preferable that the cylinder 34 should be formed in a hollow shape so that the piston 36 can be linearly reciprocated in the cylinder 34, have the compression space P at its one side, and be disposed in alignment with the inlet pipe 32*a* when its one end is positioned closely to the inside of the inlet pipe 32*a*.

Of course, the piston 36 is provided at one end of the cylinder 34 close to the inlet pipe 32*a* to be linearly reciprocated in the cylinder 34, and the discharge valve assembly 54 is provided at the other end of the cylinder 34 opposite to the inlet pipe 32*a*.

Here, the discharge valve assembly 54 includes a discharge cover 54*a* provided to define a given discharge space at a one-end side of the cylinder 34, a discharge valve 54*b* provided to open and close one end of the cylinder 34 near the compression space P, and a valve spring 54*c* which is a kind of coil spring applying an elastic force between the discharge cover 54*a* and the discharge valve 54*b* in the axial direction. An O-ring R is fitted into the inner circumference of one end of the cylinder 34 so that the discharge valve 54*a* can be closely attached to the one end of the cylinder 34.

Moreover, a bent loop pipe 58 is connected between one side of the discharge cover 54*a* and the outlet pipe 32*b*. The loop pipe 58 not only guides the compressed refrigerant to be discharged to the outside, but also prevents vibration produced by interactions between the cylinder 34, the piston 36 and the linear motor 40 from being transferred to the entire hermetic container 32.

Accordingly, as the piston 36 is linearly reciprocated in the cylinder 34, if the pressure inside the compression space P exceeds a given discharge pressure, the valve spring 54*c* is compressed to open the discharge valve 54*b*, so that the refrigerant is completely discharged from the compression space P to the outside along the loop pipe 58 and the outlet pipe 32*b*.

Next, a refrigerant passage 36*a* is defined in the center of the piston 36 so that the refrigerant introduced from the inlet pipe 32*a* can flow therethrough, the linear motor 40 is connected directly to one end of the piston 36 close to the inlet pipe 32*a* by a connection member 47, and the suction valve 52 is provided at the other end of the piston 36 opposite to the inlet pipe 32*a*. The piston 36 is elastically supported in its motion direction by various springs.

Here, the suction valve 52 is formed in a thin plate shape with its central portion partially cut away to open and close the refrigerant passage 36*a* of the piston 36 and with its one side fixed to one end of the piston 36 by screws.

Therefore, as the piston 36 is linearly reciprocated in the cylinder 34, if the pressure of the compression space P becomes equal to or lower than a given suction pressure which is lower than a discharge pressure, the suction valve 52 is open, so that the refrigerant is sucked into the compression space P, and if the pressure of the compression space P exceeds the given suction pressure, the refrigerant is compressed in the compression space P with the suction valve 52 closed.

Particularly, the piston 36 is elastically supported in its motion direction. Specifically, a piston flange 36*b* protruding in the radial direction from one end of the piston 36 close to the inlet pipe 32*a* is elastically supported in the motion direction of the piston 36 by mechanical springs 38*a* and 38*b* such as coil springs, and the refrigerant contained in the compression space P on the opposite side to the inlet pipe 32*a* operates as a gas spring due to its own elastic force, thereby elastically supporting the piston 36.

Here, the mechanical springs 38*a* and 38*b* have a constant mechanical spring constant Km regardless of the load. It is preferable that the mechanical springs 38*a* and 38*b* should be provided respectively on the cylinder 34 and a given supporting frame 56 fixed to the linear motor 40 side by side in the axial direction, based on the piston flange 36*b*. It is preferable that the mechanical spring 38*a* supported on the supporting frame 56 and the mechanical spring 38*b* provided on the cylinder 34 should have the same mechanical spring constant Km.

However, the gas spring has a gas spring constant Kg changed according to the load. As the ambient temperature rises, the pressure of the refrigerant increases, and thus a own elastic force of the gas contained in the compression space P increases. Therefore, the higher the load, the larger the gas spring constant Kg of the gas spring.

Here, while the mechanical spring constant Km is constant, the gas spring constant Kg is changed according to the load. As a result, the entire spring constant is changed according to the load, and the natural frequency fn of the piston 36 is also changed according to the gas spring constant Kg.

Accordingly, even if the load is changed, the mechanical spring constant Km and the mass M of the piston 36 are constant, but the gas spring constant Kg is changed, so that the natural frequency fn of the piston 36 is significantly influenced by the gas spring constant Kg depending upon the load.

Of course, the load can be measured in various ways. However, since the linear compressor includes a freezing/air conditioning cycle for compressing, condensing, evaporating and expanding the refrigerant, the load can be defined as a difference between a condensation pressure at which the refrigerant is condensed and an evaporation pressure at which the refrigerant is evaporated, and further is determined in consideration of an average pressure which is an average of the condensation pressure and the evaporation pressure so as to improve the accuracy.

That is, the load is calculated to be proportional to the difference between the condensation pressure and the evaporation pressure and the average pressure thereof. The higher the load, the larger the gas spring constant Kg. For example, the larger the difference between the condensation pressure and the evaporation pressure, the higher the load. Although the difference between the condensation pressure and the evaporation pressure is the same, the higher the average pressure, the higher the load. The gas spring constant Kg is calculated so that it can be increased according to such a load. The linear compressor may include a sensor (pressure sensor, temperature sensor, etc.) to calculate the load.

Here, a condensation temperature substantially proportional to the condensation pressure and an evaporation temperature substantially proportional to the evaporation pressure are measured, and then the load is calculated to be proportional to a difference between the condensation temperature and the evaporation temperature and an average temperature thereof.

Specifically, the mechanical spring constant Km and the gas spring constant Kg can be determined by means of various experiments. If the ratio of the gas spring constant Kg to the entire spring constant increases, a resonance frequency of the piston 36 can be changed in a relatively wide range according to the load.

The linear motor 40 includes an inner stator 42 configured in a manner that a plurality of laminations 42*a* are stacked in the circumferential direction and fixed to the outside of the cylinder 34 by the frame 48, an outer stator 44 configured in a manner that a plurality of laminations 44*b* are stacked in the circumferential direction around a coil winding body 44*a* wound with a coil and provided outside the cylinder 34 by the frame 48 with a given gap from the inner stator 42, and a permanent magnet 46 positioned in the gap between the inner stator 42 and the outer stator 44 and connected to the piston 36 by the connection member 47. The coil winding body 44*a* may be fixed to the outside of the inner stator 42.

The linear motor 40 is one embodiment of the motor 23 described above.

Figure 5:
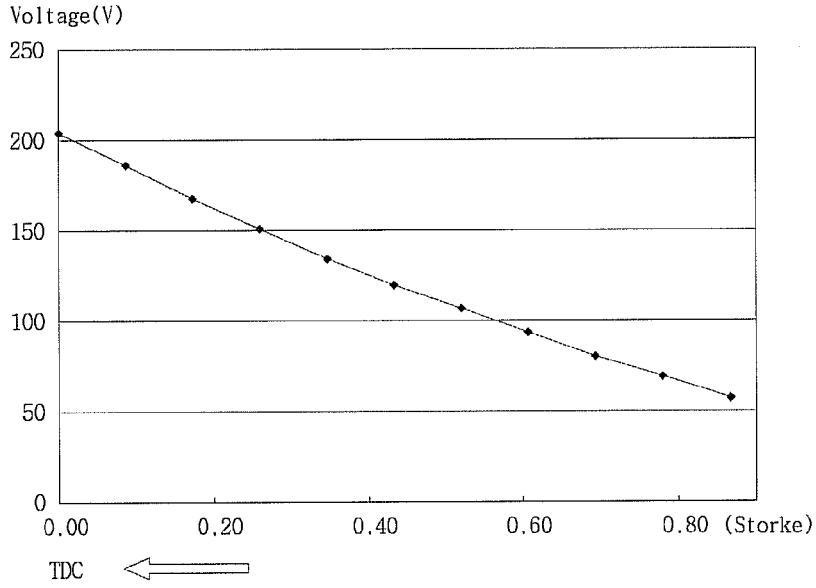
FIG. 5 is a graph showing changes of a stroke and an input voltage of a motor in the linear compressor according to the present invention.

FIG. 5 is a graph showing changes of a stroke and an input voltage of the motor in the linear compressor according to the present invention.

As illustrated in FIG. 5, in the linear compressor according to the present invention, even if the piston 36 approaches the top dead center, the input voltage of the motor rises. Therefore, the linear compressor according to the present invention can perform the variability (modulation) of the cooling capacity in a stable state. That is, the control unit 25 can control the AC voltage applied to the motor 23 so that the stroke of the piston 36 which is a movable member is proportional to the magnitude of the AC voltage applied to the motor 23, and thus perform the naturally variable rate of the cooling capacity based on the load by the reciprocation of the piston 36.

In particular, the stroke of the piston 36 is proportional to the magnitude of the AC voltage applied to the motor 23 at least in close proximity to the top dead center of the piston 36, thereby preventing the stroke jump phenomenon.

Figure 6:
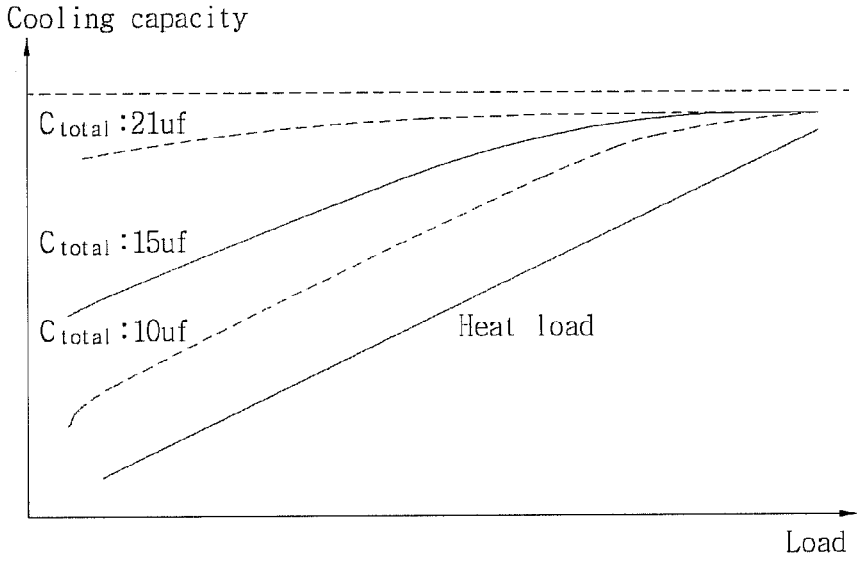
FIG. 6 is a graph showing changes of a cooling capacity and a load in the linear compressor according to the present invention.

FIG. 6 is a graph showing changes of the cooling capacity and the load in the linear compressor according to the present invention. In this embodiment, it is presumed that the capacity C of the capacitor C2 is 21 μF.

As shown in FIG. 6, when the software-type capacitor Cr is not provided, the total capacity Ctotal becomes equal to the capacity C of the capacitor C2. Here, a cooling capacity variability (modulation) curve I appears to be a fixed cooling capacity variability (modulation) curve.

When the total capacity Ctotal is 10 μF, a cooling capacity variability (modulation) curve II is obtained, in which the cooling capacity is varied most approximate to the load.

When the total capacity Ctotal is 15 a cooling capacity variability (modulation) curve III is obtained that has an approximately middle cooling capacity variability (modulation) rate with respect to the cooling capacity variability (modulation) curve I and the cooling capacity variability (modulation) curve II.

As for the adjustment of the variable rate of a cooling capacity, the control unit 25 stores a variable constant 1/Cr and varies the magnitude of Cr or 1/Cr based on the necessity of a low, mid and high cooling capacity, so that it can perform the variability of the cooling capacity such as e.g. the cooling capacity variability (modulation) curve II or III.

In addition to the control based on the necessity of the cooling capacity, for example, even if a low cooling capacity is required during the control of setting the total capacity Ctotal as 10 μF, the control device can set the total capacity Ctotal as 15 μF according to a special input or control algorithm, thereby generating an additional cooling capacity.

Consequently, the control unit 25 according to the present invention can control the variable rate of a cooling capacity by varying the constant 1/Cr or Cr. That is, still referring to FIG. 6, when the control unit 25 determines a specific capacity Ctotal, the magnitude of Cvirtual can be operated by the following Formula, using Formula 1:

$$Cvirtual=C/(C/Ctotal-1) \qquad \text{Formula 2}$$

According to Formula 2, the magnitude of the constant Cr is set to correspond to Cvirtual.

As Cr varies, a phase difference between the motor application voltage Vmotor and the current i decreases at a low load, so that a higher cooling capacity can be accomplished at the same load. That is, the LC resonance frequency is determined by the value of Ctotal, and the phases of the motor application voltage Vmotor and the current i are determined at a certain load. Here, if Ctotal varies, the phases of the motor application voltage Vmotor and the current i are changed, and thus the entire power is changed. In other words, since the cooling capacity increases or decreases, the naturally variable rate of the cooling capacity rate is changed.

Figure 7:
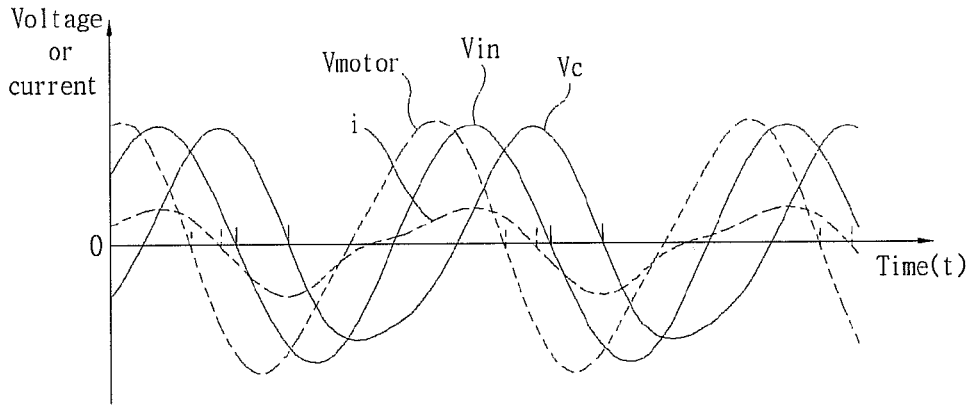
FIG. 7 is a graph showing voltages of the linear compressor according to the present invention.

FIG. 7 is a graph showing voltages of the linear compressor according to the present invention. As shown, the actual motor application voltage Vmotor is operated by subtracting the attenuation voltage Vc, which is operated from the current i, from the application voltage Vin. The motor application voltage Vmotor becomes equal to a voltage applied to a motor in a circuit in which a single or plural capacitors are connected in series to a coil L. As a result, it is possible to control the cooling capacity variability of the linear compressor.

The present invention has been described in detail with reference to the exemplary embodiments and the attached drawings. However, the scope of the present invention is not limited to such embodiments and drawings, but is defined by the appended claims.

What is claimed is:

1. A linear compressor, comprising:

a fixed member having a compression space therein;

a movable member linearly reciprocated in the fixed member to compress a refrigerant sucked into the compression space;

one or more springs provided to elastically support the movable member in a motion direction of the movable member;

a motor unit including a motor connected to the movable member to linearly reciprocate the movable member in an axial direction and a capacitor connected in series to the motor; and a motor control unit controlling an AC voltage applied to the motor to adjust a variable rate of a cooling capacity by the reciprocation of the movable member, wherein the motor control unit comprises:

a rectification unit receiving AC power and outputting a DC voltage;

an inverter unit receiving the DC voltage, converting the DC voltage to an AC voltage according to a control signal, and supplying the AC voltage to the motor unit;

a current sensing unit sensing a current flowing through the motor unit; and a control unit integrating the current from the current sensing unit, calculating an attenuation voltage by multiplying the integrated value by a constant 1/Cr, wherein Cr is a capacitance, generating the control signal for producing the AC voltage corresponding to a difference between a set voltage and the attenuation voltage, and applying the control signal to the inverter unit.

2. The linear compressor of claim 1, wherein a stroke of the movable member is proportional to a magnitude of the AC voltage applied to the motor at least in close proximity to top dead center of the movable member.

3. The linear compressor of claim 1, wherein the motor control unit comprises an attenuation operation unit attenuating an inductance effect of a coil of the motor by using the current flowing through the motor unit.

4. The linear compressor of claim 1, wherein the constant 1/Cr is variable.

5. The linear compressor of claim 4, wherein the variable rate of the cooling capacity of the compressor is adjusted by varying the constant 1/Cr.

6. The linear compressor of claim 4, wherein the control unit controls a total capacity of the capacitor connected in series to the motor.

7. A method for controlling a linear compressor which includes a fixed member having a compression space therein, a movable member provided in the fixed member to compress a refrigerant sucked into the compression space, one or more springs provided to elastically support the movable member, and a motor unit including a motor connected to the movable member to linearly reciprocate the movable member in an axial direction and a capacitor connected in series to the motor, the method comprising:

a first step of applying a preset initial voltage to the motor;

a second step of calculating a first attenuation voltage with a current produced by the application of the preset initial voltage;

a third step of calculating a first required voltage corresponding to a difference between the initial voltage and the first attenuation voltage;

a fourth step of applying the first required voltage to the motor;

a fifth step of calculating a second attenuation voltage with a current produced by the application of the first required voltage;

a sixth step of calculating a second required voltage corresponding to a difference between the initial voltage and the second attenuation voltage; and a seventh step of applying the second required voltage to the motor, and wherein the second step or the fifth step integrates the current and calculates the first or second attenuation voltage by multiplying the integrated value by a variable constant 1/Cr, wherein Cr is a capacitance.

8. The method of claim 7, wherein the fifth to seventh steps are repeatedly performed.

9. The method of claim 7, wherein the second step or the fifth step adjusts a total capacity of the capacitor connected in series to the motor.

* * * * *